United States Patent [19]

Emori et al.

[11] Patent Number: 5,066,986

[45] Date of Patent: Nov. 19, 1991

[54] IMAGE RECORDING SYSTEM FOR CONTROLLING DEVELOPING DEVICES

[75] Inventors: Kiyoshi Emori; Hiroshi Maekawa, both of Osaka, Japan

[73] Assignee: Minolta Camera Kabushiki Kaisha, Osaka, Japan

[21] Appl. No.: 304,610

[22] Filed: Feb. 1, 1989

[30] Foreign Application Priority Data

Feb. 3, 1988 [JP] Japan ..... 63-24504

[51] Int. Cl.[5] ..... G03G 15/01

[52] U.S. Cl. ..... 355/326; 346/157; 355/202

[58] Field of Search ..... 355/202, 313, 326, 327, 355/328; 346/157

[56] References Cited

U.S. PATENT DOCUMENTS

| | | | |
|---|---|---|---|
| 3,572,288 | 8/1968 | Turner . | |
| 3,914,043 | 10/1975 | McVeigh | 355/326 |
| 3,960,445 | 6/1976 | Drawe | 355/326 |
| 3,967,891 | 7/1976 | Rippstein . | |
| 4,099,860 | 7/1978 | Connin . | |
| 4,256,400 | 3/1981 | Komori et al. . | |
| 4,275,958 | 6/1981 | Tachika et al. . | |
| 4,336,994 | 6/1982 | Banton . | |
| 4,568,169 | 2/1986 | Wada et al. . | |
| 4,572,102 | 2/1986 | Yuge et al. . | |
| 4,579,443 | 4/1986 | Abuyama jet al. | 355/326 X |
| 4,582,417 | 4/1986 | Yagasaki et al. . | |
| 4,587,568 | 5/1986 | Takayama et al. . | |
| 4,627,707 | 12/1986 | Tani et al. . | |
| 4,655,580 | 4/1987 | Watanabe et al. . | |
| 4,657,376 | 4/1987 | Ide . | |
| 4,668,978 | 5/1987 | Gokita . | |
| 4,720,730 | 1/1988 | Ito . | |
| 4,723,148 | 2/1988 | Hamakawa . | |
| 4,731,637 | 3/1988 | Acquaviva et al. . | |
| 4,743,946 | 5/1988 | Nishimori et al. . | |
| 4,745,437 | 5/1988 | Oka et al. . | |
| 4,772,921 | 9/1988 | Ito . | |

FOREIGN PATENT DOCUMENTS

| | | |
|---|---|---|
| 3705511 | 9/1987 | Fed. Rep. of Germany . |
| 48-22212 | 7/1973 | Japan . |
| 51-134635 | 11/1976 | Japan . |
| 54-30833 | 3/1979 | Japan . |
| 61-203474 | 3/1985 | Japan . |
| 60-170868 | 9/1985 | Japan . |
| 60-194469 | 10/1985 | Japan . |
| 60-212778 | 10/1985 | Japan . |
| 61-72270 | 4/1986 | Japan . |
| 62-61464 | 3/1987 | Japan . |
| 62-90186 | 6/1987 | Japan . |
| 62-59504 | 12/1987 | Japan . |

*Primary Examiner*—Fred L. Braun

*Attorney, Agent, or Firm*—Burns, Doane, Swecker & Mathis

[57] ABSTRACT

A printer apparatus is connected to a host for forming images which includes a photosensitive member, an image former for forming an electrostatic latent image on the surface of the photosensitive member, and a plurality of developing devices respectively containing different colors of developer, each of which is driven independent of one another and selectively driven for developing the electrostatic latent image formed on the surface of the photosensitive member. The apparatus also includes an image transferor for transferring the developed image to a record medium, and a controller for controlling the driving of the developing devices in a plurality of different modes during the development of the electrostatic latent image. Only one of the developing devices is driven to develop a first part of the electrostatic latent image in a first mode, at least two developing devices are driven to develope a second part of the electrostatic latent image in a second mode, and all of the developing devices are maintained deenergized to prevent the development of a third part of the electrostatic latent image in a third mode. The controller develops the electrostatic latent image by selectively driving the developing devices using at least two of the three modes.

5 Claims, 21 Drawing Sheets host device
71
B1
controller
72
B2
B3
printer engine
73
75
4
5
B9
B10
CPU for printer engine
74
B8
81
B4
B5
B7
B7'
print area counter
76
B11
comparator for 1st DEV.
77
B12
1st DEV. change-over position setting resistor
78
comparator for 2nd DEV.
79
B13
2nd DEV. change-over position setting resistor
80
B6
82 area data set for 1st DEV.

area data set for 2nd DEV.

obtained image

IMAGE RECORDING SYSTEM FOR CONTROLLING DEVELOPING DEVICES

BACKGROUND OF THE INVENTION

1. Field of the Invention

The present invention relates to an image recording system including a printer apparatus and particularly to an image recording system comprising the combination of a printer apparatus and a host control unit coupled with, for example, a personal computer or a microprocessor built into a word processor.

2. Description of the Related Arts

An electrophotographic printer coupled with a host system such as a word processor having a built in microprocessor or a business-purpose personal computer ordinarily prints images only in a single color. However, there is presently a growing trend toward the use of multicolor displays in word processors and personal computers and, to be consonant with such a trend, it is desired that electrophotographic printers also be able to produce printed outputs in a plurality of colors.

SUMMARY OF THE INVENTION

A main object of the present invention is to provide an image recording system capable of controlling the actuation of individual developing devices from among a plurality of developing devices based on change-over position data transmitted from a host unit.

Other objects of the present invention are to provide an image recording system capable of realizing the following three types of developing device change-over control modes:

(1) to actuate only one among a plurality of developing devices;

(2) to actuate a plurality of developing devices relative to a single developing region;

(3) to deactuate all developing devices relative to a single developing region.

A still further object of the present invention is to provide an image recording system capable of the aforesaid three types of developing device change-over control modes which may use the modes singly or in combination according to the contents of the print data.

These and other objects of the present invention are achieved by providing a printer apparatus connected to a host means for forming images which comprises a photosensitive member, an image forming means for forming an electrostatic latent image on the surface of said photosensitive member, a plurality of developing devices respectively containing different colors of developer each of which is driven independent of one another and selectively driven for developing the electrostatic latent image formed on the surface of the photosensitive member, an image transfer means for transferring the developed image to a record medium, and control means for controlling driving of said plurality of developing devices in a plurality of different modes during the development of the electrostatic latent image. During development, only one of said developing devices is driven to develop a first part of the electrostatic latent image in a first mode, at least two developing devices are driven to develop a second part of the electrostatic latent image in a second mode, and in a third mode all of the developing devices are maintained deenergized to prevent the development of a third part of the electrostatic latent image. The control means selectively drives the developing devices using at least two of said three modes.

These and other objects, advantages and features of the invention will become apparent from the following description thereof taken in conjunction with the accompanying drawings which illustrate specific embodiments of the invention

BRIEF DESCRIPTION OF THE DRAWINGS

In the following description, like parts are designated by like reference numbers throughout the several drawings.

FIG. 12(*b*) shows the area data set mode for the second developing device.

FIG. 12(*c*) is an illustration explaining the image obtained from the selected area data based on the area data sets shown in FIG. 12(*a*) and FIG. 12(*b*).

FIG. 17(*b*) is a flow chart of the second developing device interrupt processing routine.

FIG. 18(*b*) is a flow chart of the second developing device control routine.

DETAILED DESCRIPTION OF THE PREFERRED EMBODIMENTS

A single embodiment of the present invention relates to a printer capable of single-cycle two-color printing within a single printed page (hereinafter referred to as single-cycle two-color printing) by switching developing devices is explained hereinafter with reference to the accompanying drawings.

Figure 1:
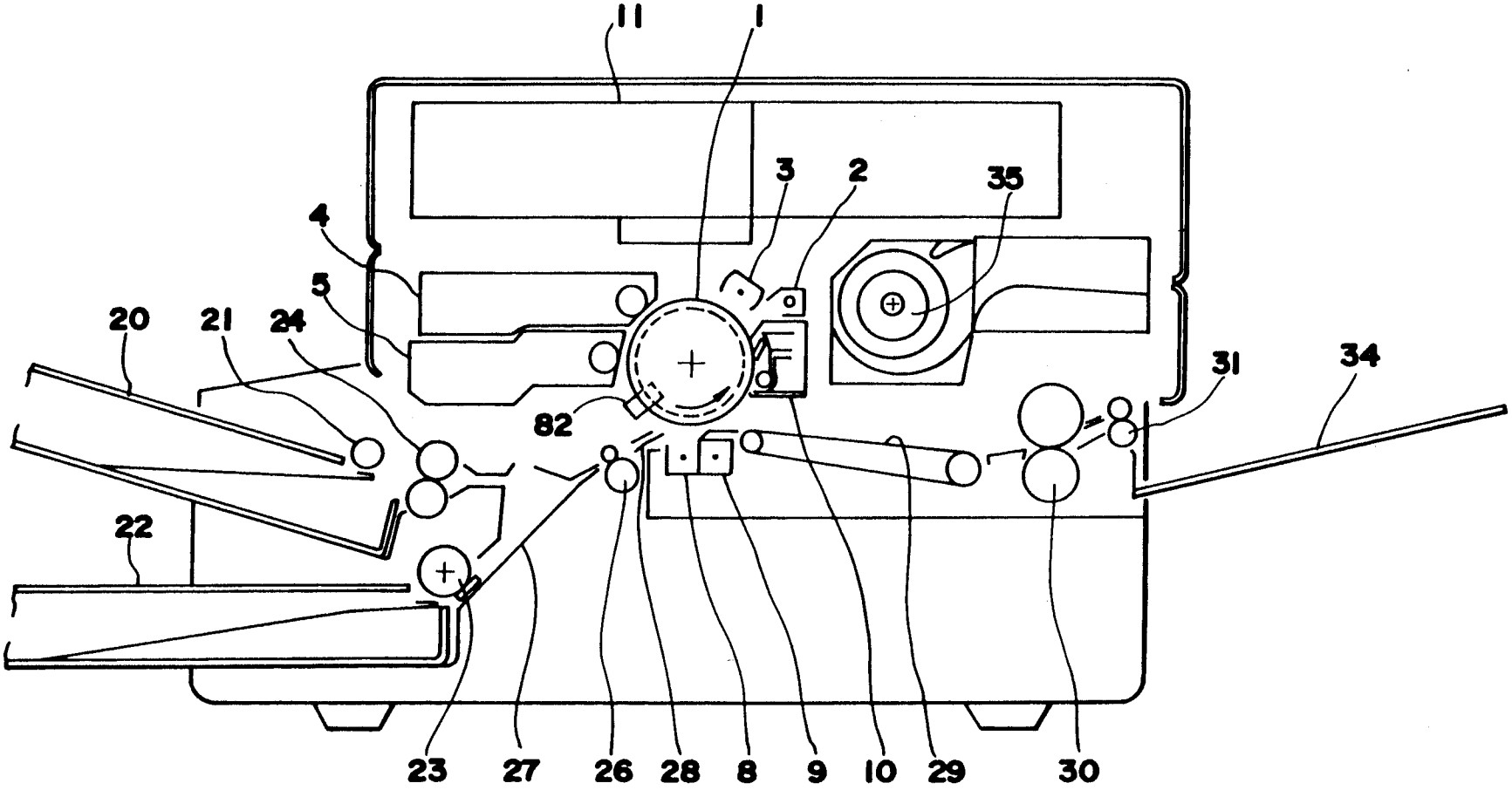
FIG. 1 is a brief cross section view of a printer which is the single embodiment of the present invention and which employs the image recording system of the present invention.

FIG. 1 is a brief cross section view showing the construction of a printer embodying the present invention.

Disposed in the center of the printer is a photosensitive drum 1 which is rotatable in the counterclockwise direction, and sequentially arranged around the circumference of said photosensitive drum 1 are main eraser lamp 2, corona charger 3, first developing device 4, second developing device 5, transfer charger 8, copy paper separation charger 9, blade-type cleaning device 10. Photosensitive drum 1 has a photosensitive layer provided on the surface thereof, is exposed to the light of eraser lamp 2 with each rotation of said drum 1, is charged by passing by corona charger 3, and is subjected to exposure of image data by the ON/OFF switching of a laser beam emitted from laser device 11.

On the left side of the printer is disposed a vertically integrated, dual-level paper supply opening having top paper cassette 20 and bottom paper cassette 22 mounted thereto and which are provided with paper take-up rollers 21 and 23 respectively. The transport path of the copy paper stored within the aforesaid paper cassettes 20 and 22 is formed by roller set 24, timing roller set 26, guide panel 27, pre-transfer position guide panel 28, transport belt 29, fixing device 30, and discharge roller 31.

Image data generated by the host unit is exposed onto the surface of photosensitive drum 1 by the ON/OFF switching of the aforesaid laser beam so as to form an electrostatic latent image on said drum 1. Toner stored in first and second developing devices 4 and 5 adheres to said electrostatic latent image through the selective actuation of said first and second developing devices 4 and 5. The toner image thus formed on the surface of photosensitive drum 1 is transferred by transferred charger 8 to a sheet of copy paper transported from the previously described timing roller set 26 so as to have its front edge aligned with the toner image region. The sheet of copy paper is then separated from the surface of photosensitive drum 1 by separation charger 9 and transported by feed belt 29 to fixing device 30 which fuses the toner to the paper, and thereafter said copy paper is discharged to discharge tray 34 by discharge roller set 31. Item 35 is a discharge fan, and photosensitive drum 1, paper take-up rollers 21 and 23, roller set 24, timing roller set 26, first developing device 4, second developing device 5, feed belt 29, fixing device 30, and discharge roller 31 are driven by a main motor not shown in the drawing. The aforesaid paper take-up rollers 21 and 23, timing roller set 26, roller set 24, and first and second developing devices 4 and 5 are constructed in such a way that the drive force of the main motor applied thereto can be switched between drive and non-drive modes via solenoids, electromagnetic spring clutches and the like (not shown in the drawing) so as to have each of the aforesaid components independently actuable. Item 82 is a photosensitive drum rotation detecting encoder which detects the rotation of said photosensitive drum 1 by means of a pulse counter.

FIGS. 2 through 7 are illustrations explaining the construction of the developing device and the switchable drive used in the present embodiment.

Figure 2:
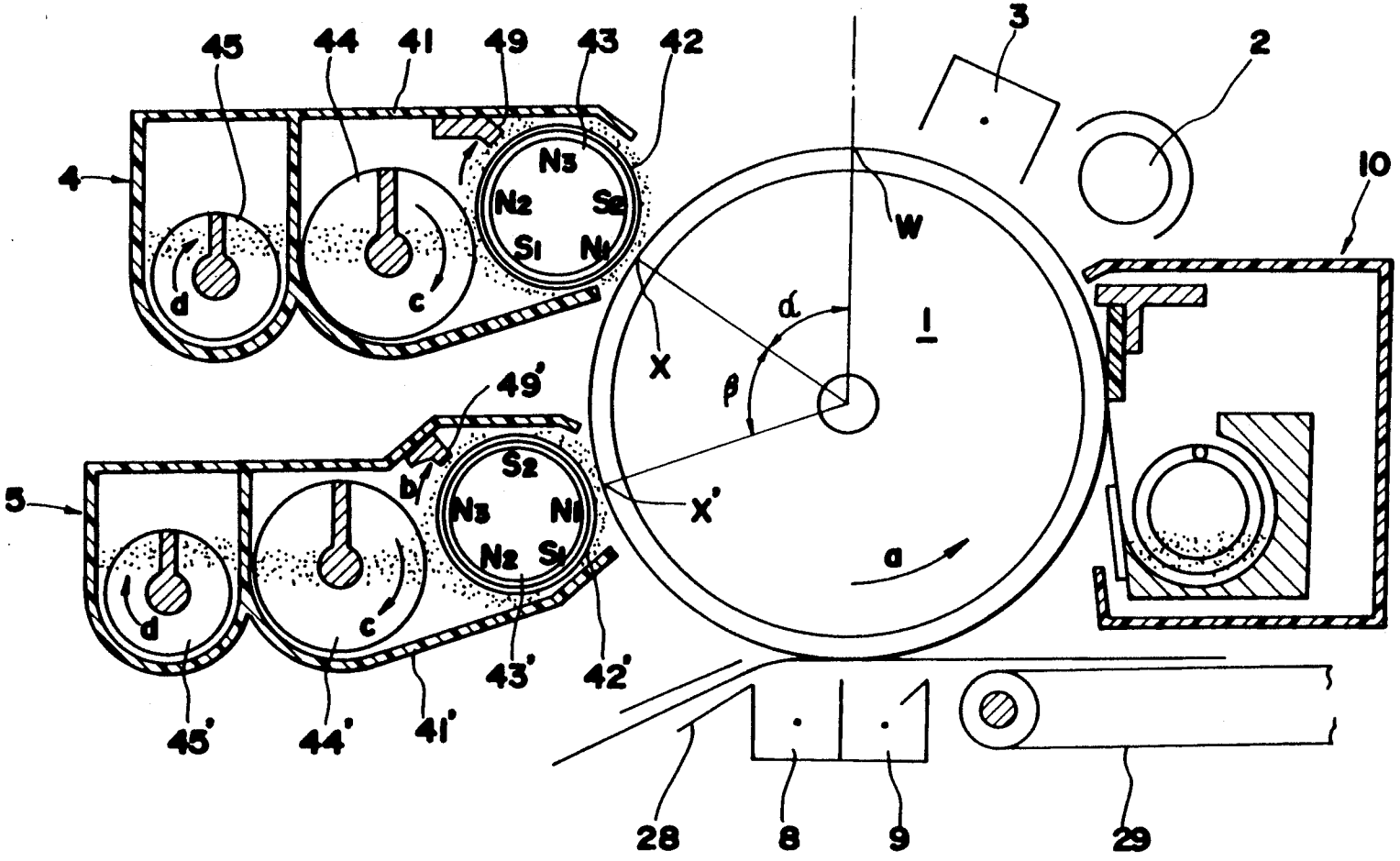
FIG. 2 is a cross sectional view of the developing devices and photosensitive drum of the present invention.

Developing devices 4 and 5 are constructed as shown in FIG. 2. Within developer tank 41, 41' sequentially from the photosensitive drum 1 side are arranged developing sleeves 42, 42' supply rollers 44, 44' and screws 45, 45'.

Developing sleeves 42, 42' are formed in a cylindrical shape ($\phi$=24.5 mm) of non-magnetic conductive material, and their exterior surfaces are subjected to a sandblasting process to form fine irregularities on the surfaces thereof, and are disposed opposite developing positions X and X' with the developing gaps Ds between said sleeves 42, 42' and photosensitive drum 1 being 0.6 mm; the angle of rotation from exposure point W to said developing positions X and X' is set at $\alpha$ and $\alpha+\beta$ respectively.

Further, brush height regulating members 49, 49' are provided at the upper interior surface of developer tanks 41, 41' at the top of developing sleeves 42, 42' on the side opposite developing position X, and have brush height regulating member gaps Db of 0.4 mm.

The interior of developing sleeves 42, 42' are provided with magnetic rollers 43, 43' having a plurality of magnets arranged in the axial direction. The magnetic force of magnetic poles N1 to N3 and S1 and S2 positioned at the outer surface of said magnets are, respectively, N1=1000 G, N2 and N3=500 G, S1 and S2=800 G (where G is the abbreviation for Gaussian units).

Figure 4:
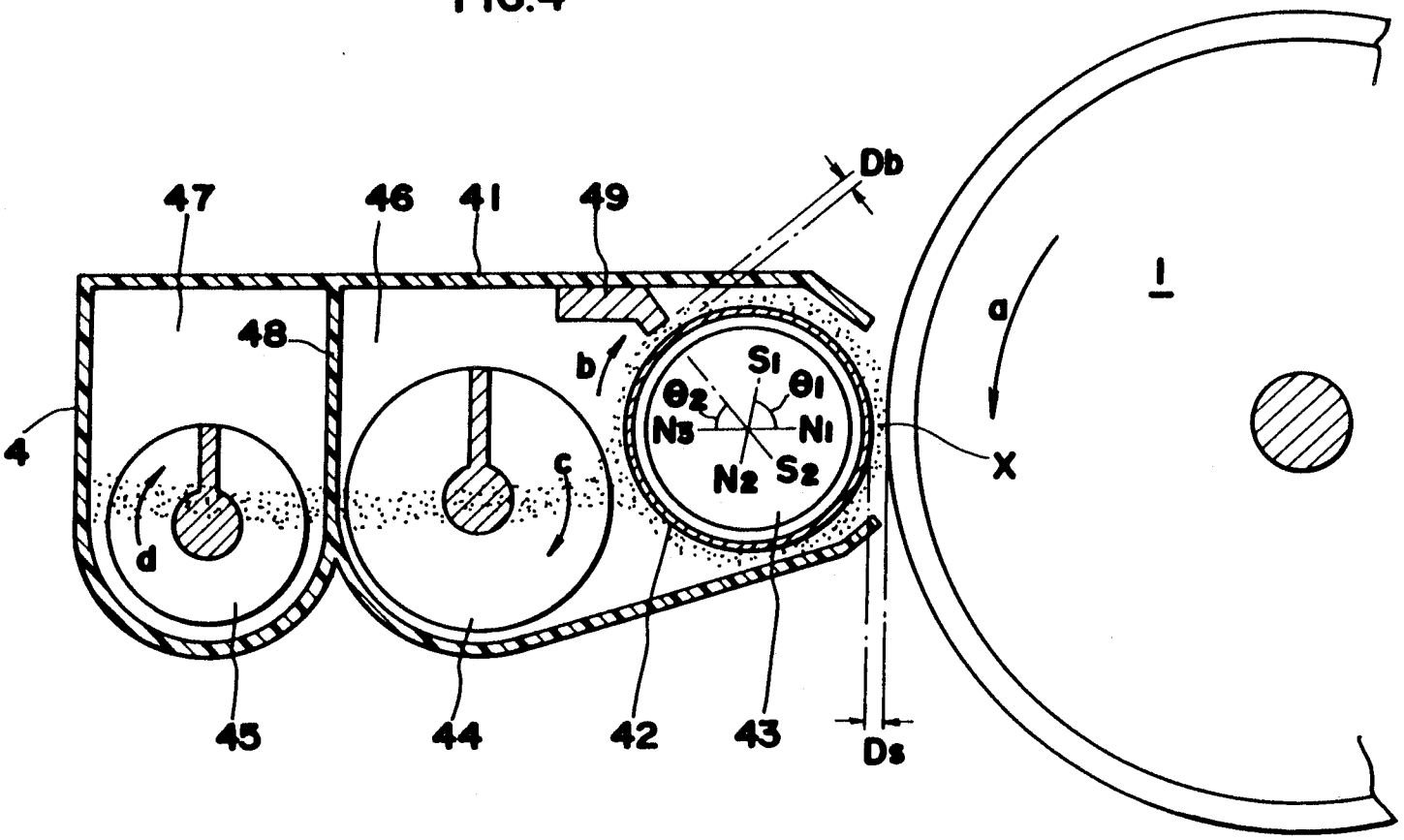
FIGS. 4 and 6 are cross sectional views of a developing device of the present invention showing different angular orientations of the magnetic roller.

The center of magnetic pole N1, as shown in FIG. 4, is arranged at a position advanced $\theta 1$ (80°) clockwise from the center of magnetic pole S1. Magnetic pole N3 is arranged at a position advanced $\theta 2$ (40°) counterclockwise from the portion opposite brush height regulating members 49, 49' when magnetic pole N1 is disposed opposite photosensitive drum 1.

Figure 3:
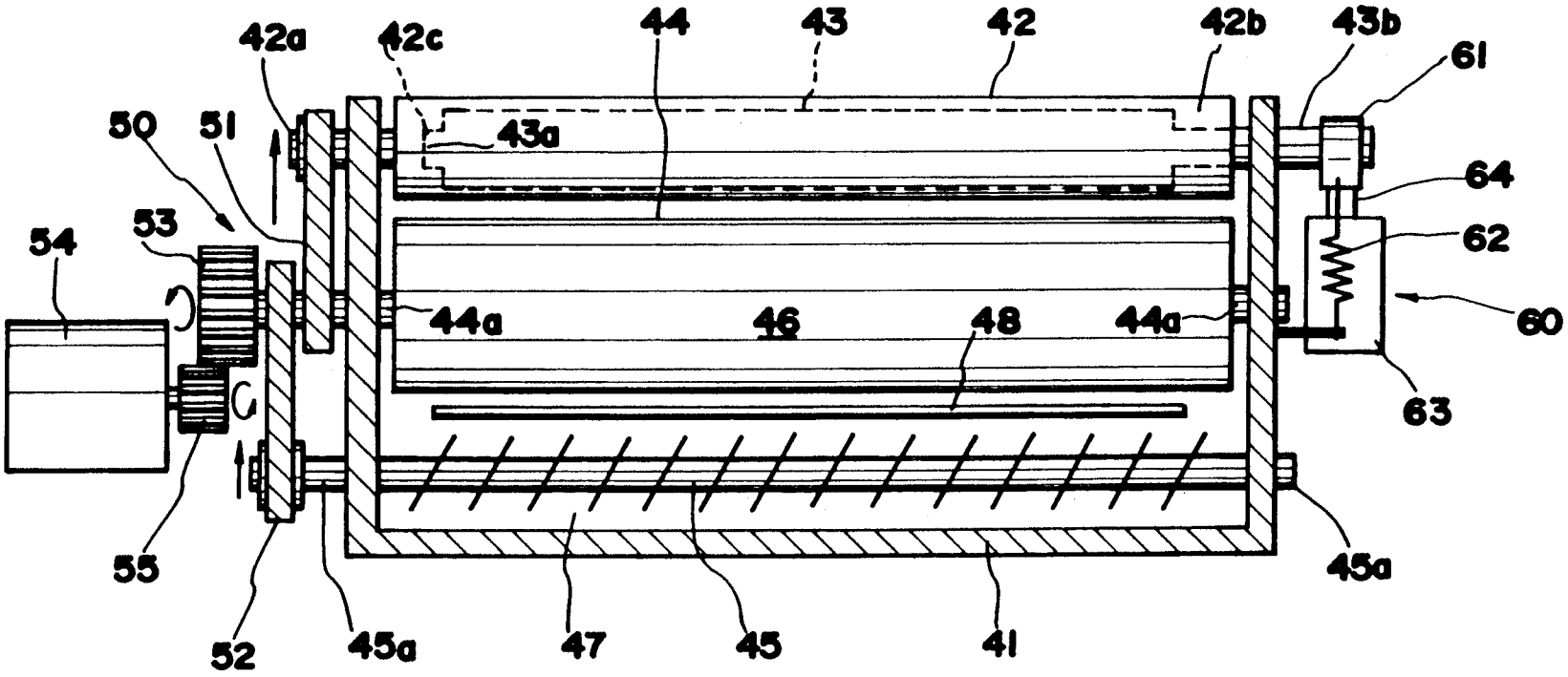
FIG. 3 is a cutaway view of a developing device of the present invention.

With reference to FIG. 3, end portion 43*a* of the shaft for magnetic roller 43 is supported by bearing receptable 42*c* provided inside developing sleeve 42, while the other end 43*b* of said magnetic roller 43 shaft is supported by the side panel of developer tank 41 and is rotatable a specific angle ($\theta 1$=40°) by advancing means 60 described in detail hereinafter.

On the other hand, bearing 42*b* of developing sleeve 42, shown on the right side in FIG. 3, is supported by shaft 43*b* of magnetic roller 43. Shaft 42*a* on the opposite side is supported by the side panel of the developer tank 41 and is rotatable by means of drive means 50.

Feed roller 44 and screw 45 are provided respectively in transport paths 46 and 47 divided by partition panel 48. Shafts 44*a* and 45*a* of rollers 44 and 45, respectively, are supported by the side wall of developer tank 41 so as to be rotationally driven by drive means 50.

Transport paths 46 and 47 are linked at both sides of developer tank 41, as shown in FIG. 3.

A description of drive means 50 for developing devices 4 and 5, feed roller 44 and screw 45 follows hereafter.

As shown in FIG. 3, a belt 51 is attached to shaft 42*a* of developing sleeve 42 and shaft 44*a* of feed roller 44, and a belt 52 is attached to shaft 44*a* of feed roller 44 and shaft 45*a* of screw 45.

Further, to one end of shaft 44*a* of feed roller 44 is mounted a gear 53, said gear 53 engaging drive grear 55 of motor 54.

Accordingly, when motor 54 is actuated and the drive gear 55 is rotated in the direction of the solid arrow, as shown in FIG. 3, gear 53 and belts 51 and 52 are driven in the respective arrow directions, and developing sleeve 42, feed roller 44 and screw 45 are rotated in the directions of arrows b, c and d respectively, as shown in FIG. 2. Developing sleeve 42 rotates at a rate of 240 rpm.

Figure 5:
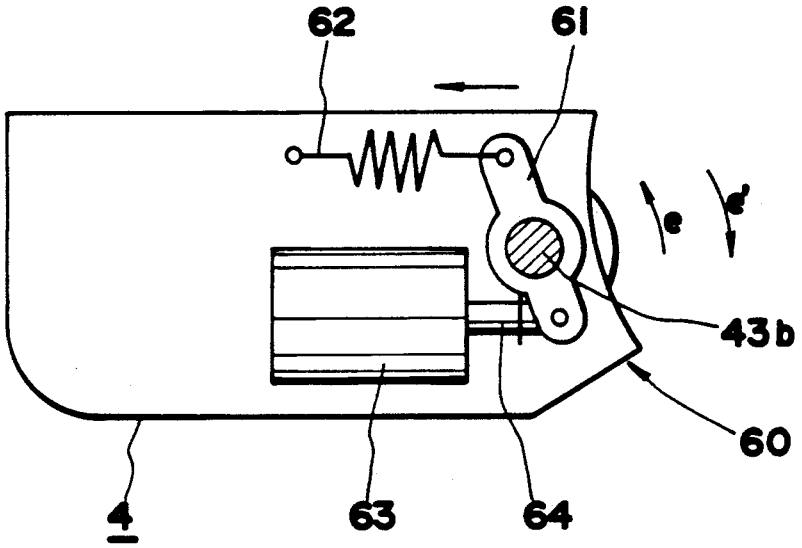
FIGS. 5 and 7 are end views of the magnetic roller advancing means in different operating positions.
Figure 7:
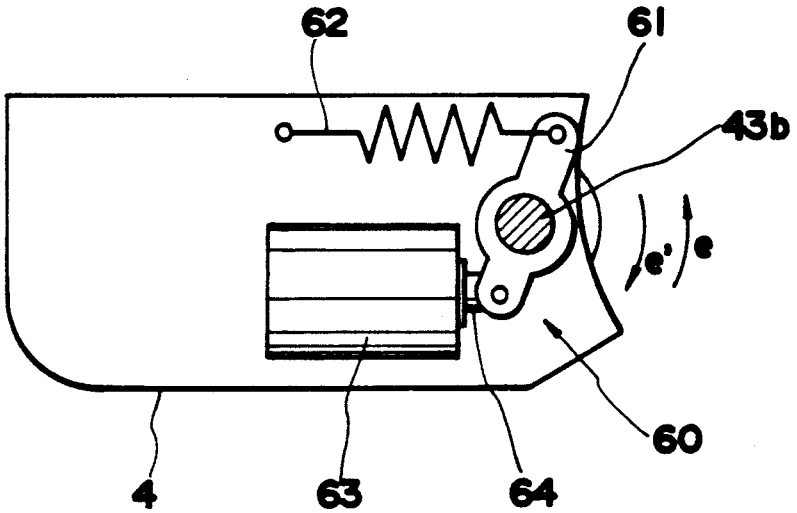

The aforesaid advancing means 60 of magnetic roller 43 comprises a lever 61, spring 62 and solenoid 63, as shown in FIGS. 5 and 7. Lever 61 is fixedly mounted to one end of shaft 43*b* of magnetic roller 43; an end of lever 61 has a spring 62 attached thereto, the opposite end of said spring 62 being fixedly attached to developing tank 41 so as to normally apply a spring force in the arrow e direction. Further, the opposite end of lever 61 is connected to plunger 64 of solenoid 63 such that when solenoid 63 is actuated, lever 61 is rotated in the direction of arrow e' against the resistance of the force imparted by spring 62.

When solenoid 63 is inoperative, i.e., when lever 61 is in the state shown in FIG. 5, magnetic pole N1 of magnetic roller 43 is aligned opposite photosensitive drum 1, and magnetic pole N3 travels to a position advanced $\theta 2(40°)$ counterclockwise from the portion opposite brush height regulating member 49, as shown in FIG. 4.

Figure 6:
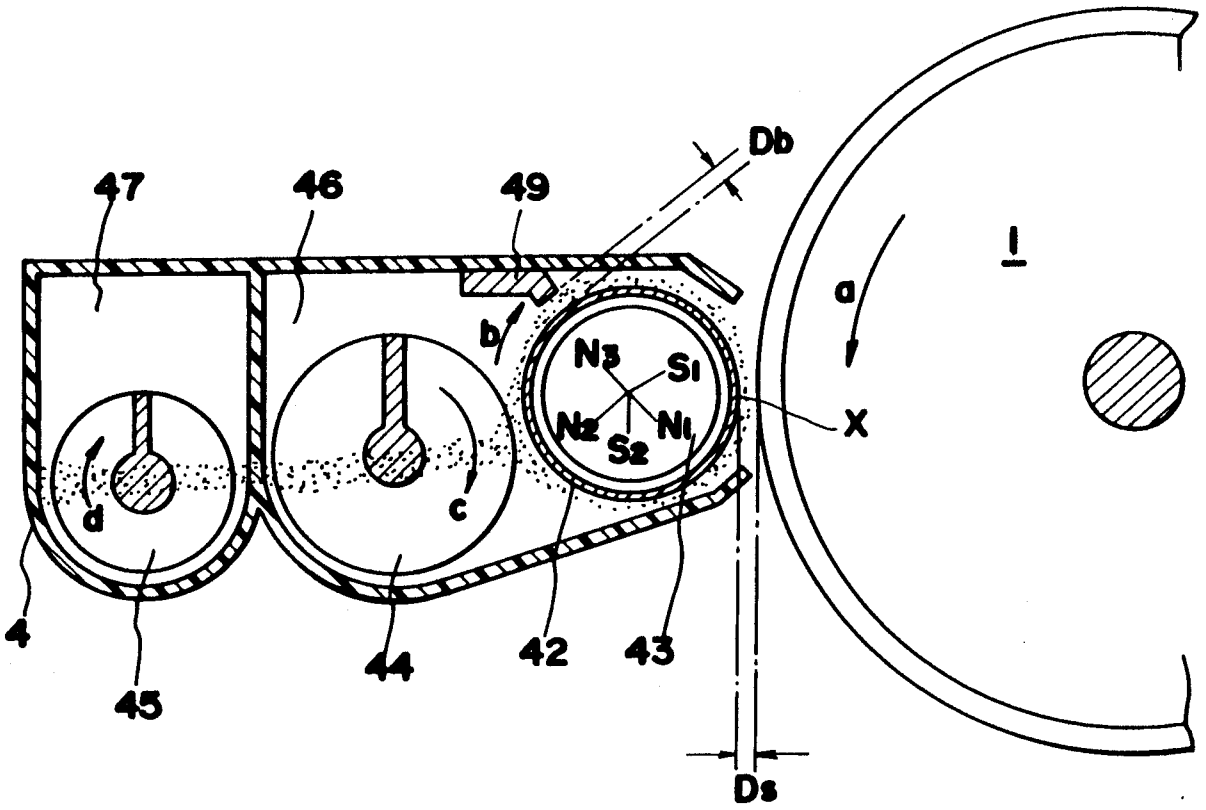

Conversely, when solenoid 63 is operative and lever 61 is in the state shown in FIG. 7, magnetic pole N3 is aligned opposite brush height regulating member 49, and the intermediate portion between magnetic poles N1 and S1 is aligned opposite photosensitive drum 1, as shown in FIG. 6.

Toner from developing device 5 adheres to photosensitive drum 1 under the conditions described in FIG. 4, and toner from developing device 5 does not adhere to photosensitive drum 1 under the conditions described in FIG. 6. That is, in the state shown in FIG. 6, the intermediate portion between both N and S magnetic poles is opposite photosensitive drum 1, thus that portion of developing sleeve 42 which lacks toner is aligned opposite said photosensitive drum 1.

When a plurality of developing devices having the aforesaid construction are used, different colored toner can be applied to different regions of a formed electrostatic latent image by means of switching actuation of said developing devices with precise timing relative to specific regions of the formed image.

Figure 8:
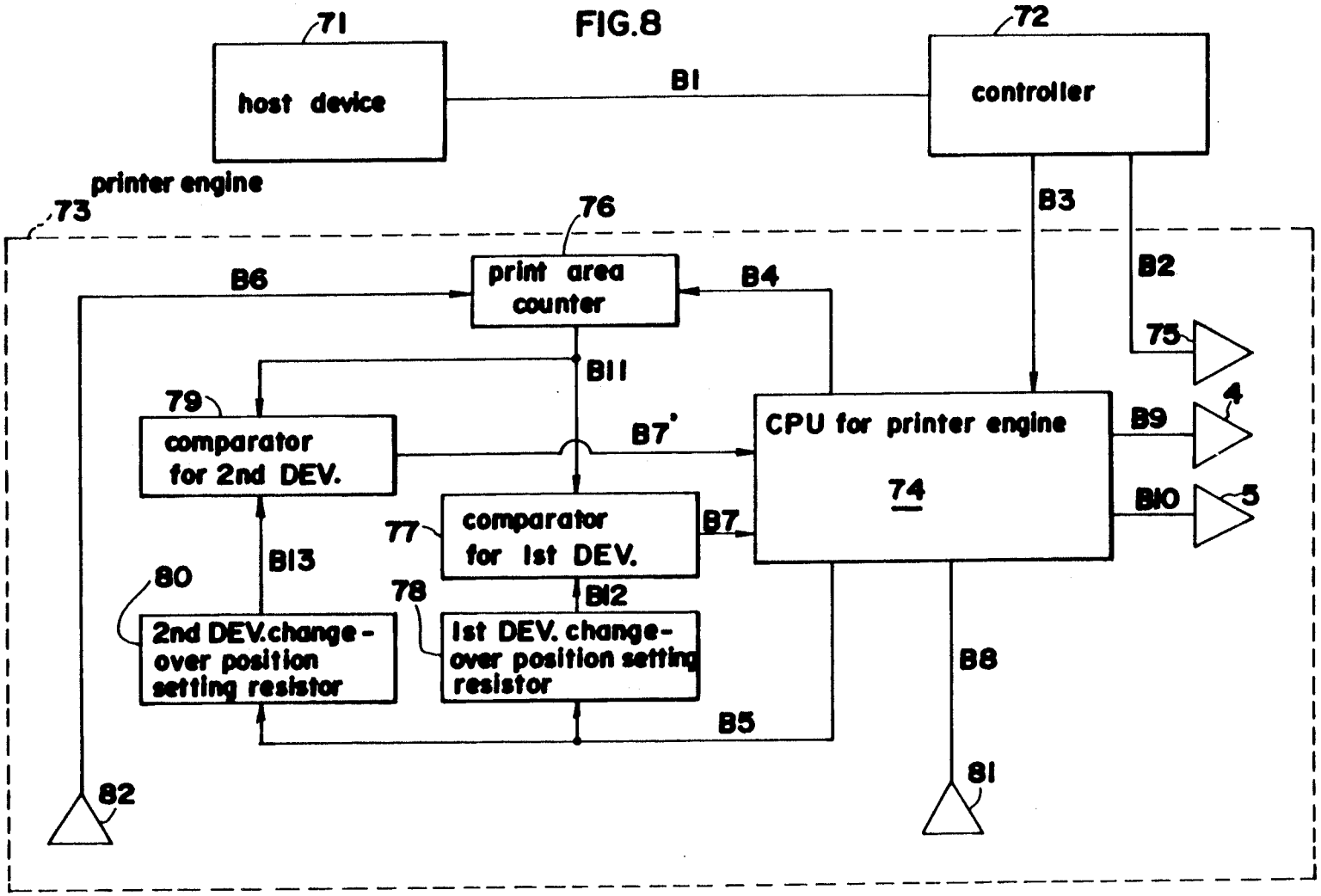
FIG. 8 is a block diagram showing the data signals transmitted and received among the host unit controller and printer engine.

FIG. 8 is a block diagram showing the transmission and reception of image data and developing device control data among host unit 71, controller 72 and printer engine 73.

Print data transmitted by host unit 71 through bus B1 includes both image data and developing device control information. Controller 72 which receives the aforesaid print data forms an actual print image (bit map) from said image data, and transmits said data to printer engine 73 through bus B2. Developing device control information is transmitted through bus B3 to printer engine 73 as status information. CPU 74 for printer engine 73 which receives the various types of data through said buses B2 and B3 drives the printer based on said data, and controls ON/OFF switching of light emitting member (laser) 75 as well as drive switching of the first and second developing devices 4 and 5 via buses B9 and B10. CPU 74 is connected to a print area counter 76 via bus B4, and controls whether or not said counter is actuated or reset through said bus B4. Counter 74 is connected to photosensitive drum rotation detection encoder 82 through bus B6 and counts the pulses generated therefrom. Through bus B5, the aforesaid CPU 74 is connected in parallel to first developing device change-over position resistor 78 and second developing device change-over position resistor 80, and is connected to first developing device change-over comparator 77 and second developing device change-over comparator 79 through buses B12 and B13 respectively. Both of said comparators 77 and 79 are connected to the aforesaid print area counter 76 through bus B11, and when the counter value of said counter 76 is detected to be comparable to the values of first and second change-over position resistors 78 and 80, the respective interrupts are transmitted to CPU 74 through buses B7 and B7'. Thus, the change-over of said developing devices is controllable through the pulses detected by photosensitive drum rotation detection encoder 82. In addition, item 81 is a raster sensor and is connected to CPU 74 through bus B8.

Figure 9:
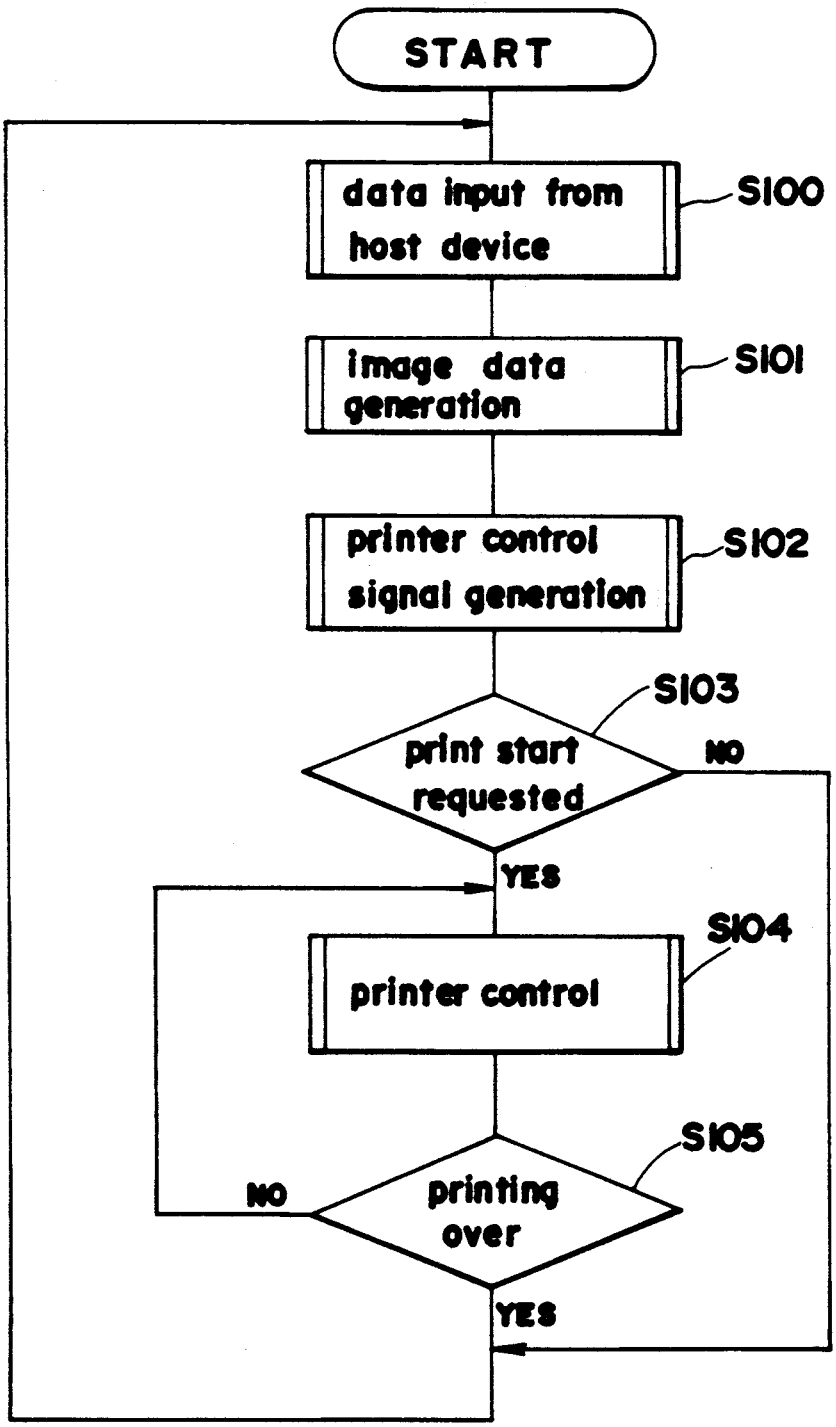
FIG. 9 is a flow chart showing the main control routine of the controller.

FIG. 9 is a flow chart showing the main routine for controller 72 control. In step S100, the data input routine is executed and image data from hcst unit 71 and printer control data are received. In step S101, the image forming routine is executed and image data are evolved in the image buffer. Then in step S102, the specific routines for each printer state are executed and printer control data are processed. The aforesaid printer control data include developing device selection, single-cycle two-color printing, paper port selection and developing device change-over timing data for single-cycle two-color printing, and specific data for mode settings of various peripheral functions. A detailed description of the main routine follows later in the description. Continuing to step S103, a determination is made as to whether or not a print request is generated by the host unit. When a print request is made (YES in S103) an instruction is output to start the printer (S104), and controller 72 enters the mode to output image data. When the temporary print mode is entered, the print mode basically continues until printing is completed in step S105, then the routine returns to the normal loop.

Figure 10:
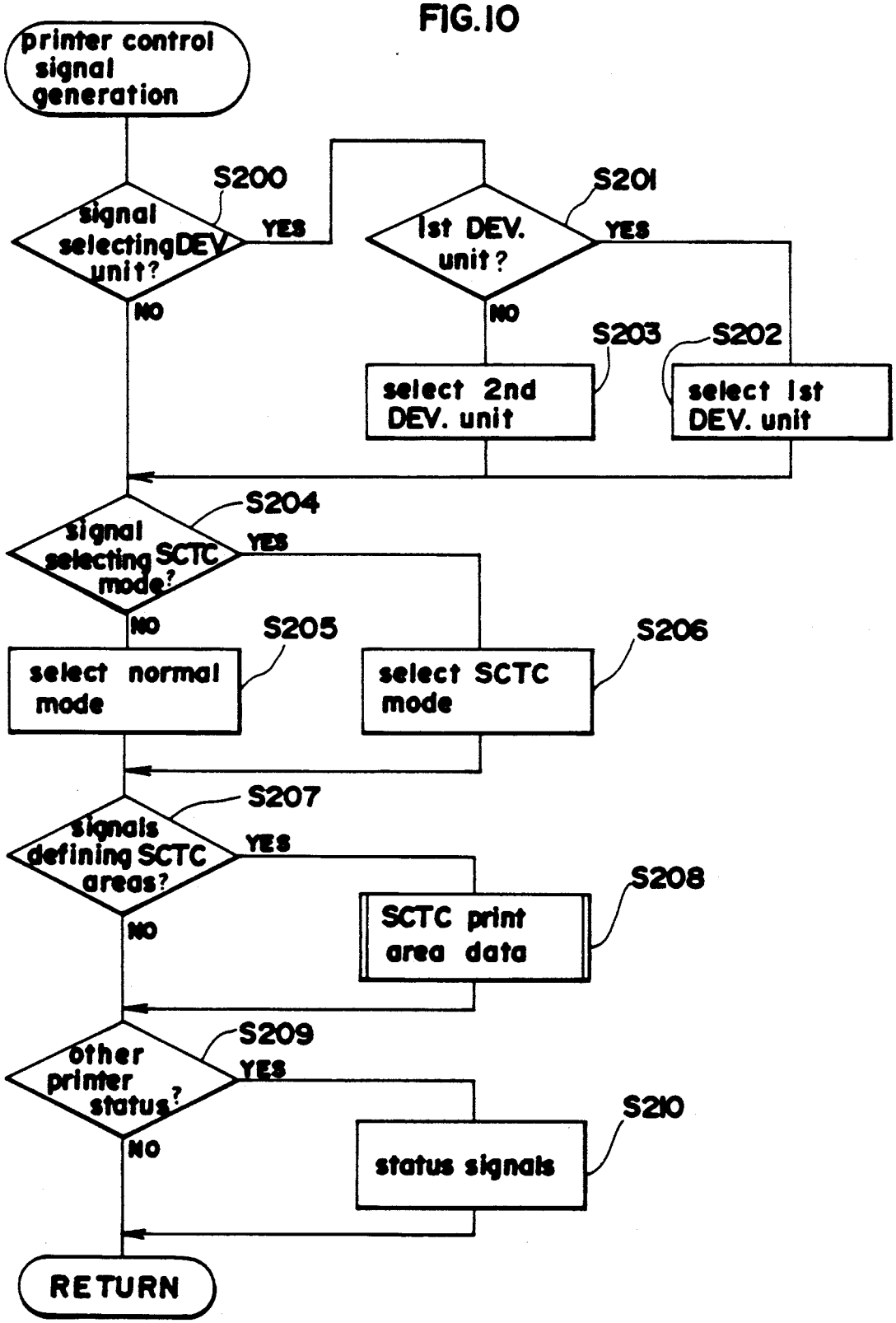
FIG. 10 is a flow chart showing the control signal generation routines for each print mode.

FIG. 10 is a flow chart showing the control signal generation routines for each print mode.

There are many printer control routines such as paper port selection, mode settings of various peripheral functions and the like, but in the main routine there are only three types of controls: developing device selection, single-cycle two-color printing and single-cycle two-color print area.

First, in step S200, a determination is made as to whether or not a developing device selection is needed. If said device selection is needed (YES), a determination is made in step S201 as to whether or not the first developing device has been selected, and if the first device has been selected the parameters are set to use said first developing device (S202), while if said first device has not been selected the parameters are set to use the second developing device (S203). Continuing to step S204, a determination is made as to whether or not single-cycle two-color printing is selected, and if not selected (NO in S204) the normal print mode is set in step S205. In the normal print mode, an entire page is completely developed by the selected developing device. When single-cycle two-color printing is selected in the aforesaid step S204, the single-cycle two-color print mode is specified in step S206. The routine continues to step S207 where a determination is made as to whether or not single-cycle two-color print area data are needed; if the determination is YES, the single-cycle two-color print area data setting routine is called in step S208. The aforesaid routine is described more fully later.

In step S209, determinations are made concerning other print selections and the parameters of the various states are set in accordance with said selections in step S210. The various printer state setting data may be held, for example, in a RAM area which is commonly accessible by the printer and printer engine, or by updating permanently accessible data by serial communications.

Figure 11:
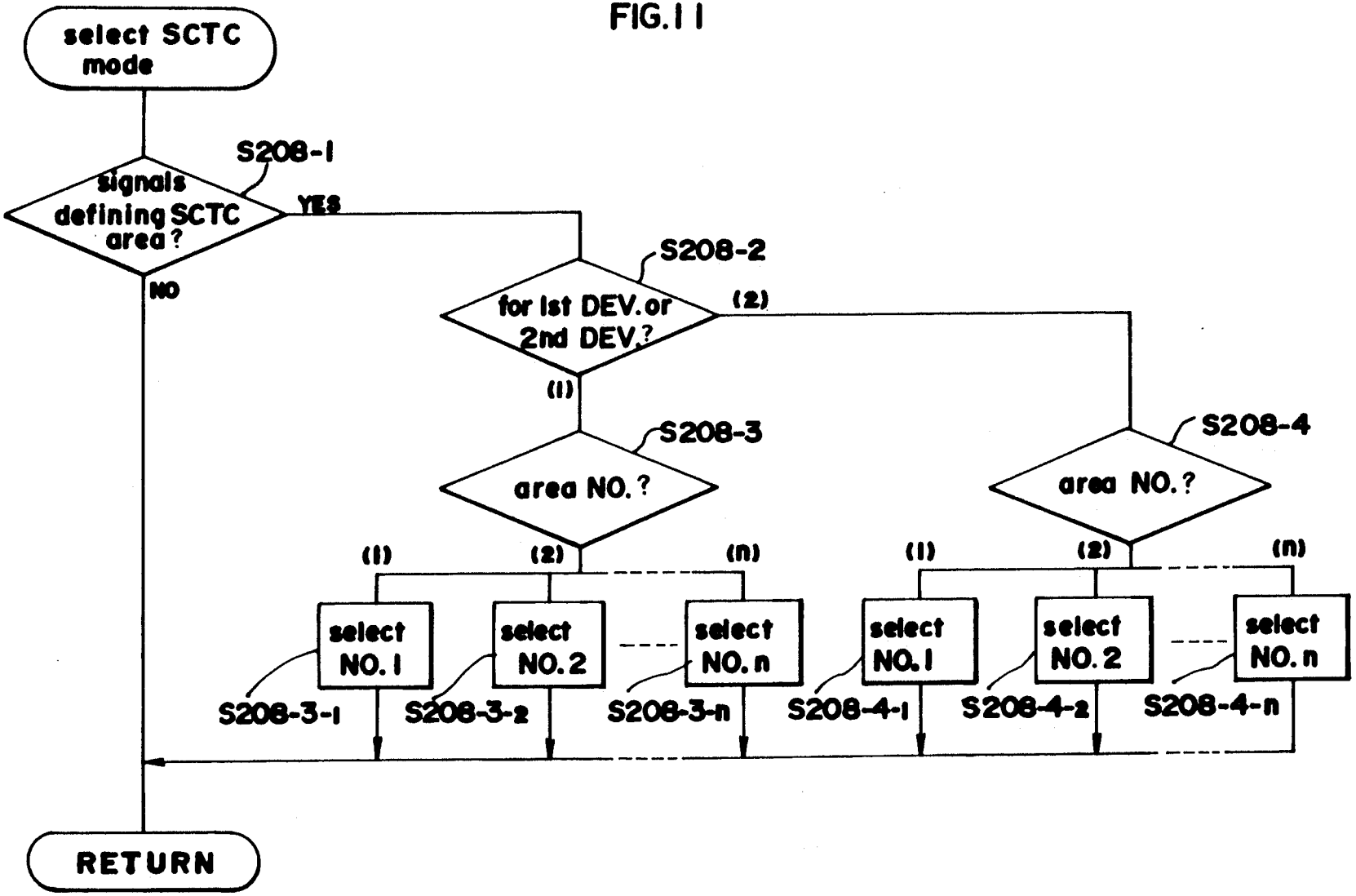
FIG. 11 is a flow chart showing the single-cycle two-color print area data selection routine.

FIG. 11 is a flow chart showing the single-cycle two-color print area data setting routine.

First, a determination is made in step S208-1 as to whether or not the developing device change-over position data, i.e. single-cycle two-color print area data, is indicated, and if so (YES), the routine continues to step S208-2 and a determination is made as to whether said area data refers to the first or second developing devices. If said area data refers to the first developing device the routine continues to step S208-3, while if said area data refers to the second developing device the routine continues to step S208-4. Single-cycle two-color print area data has preset area numbers sequentially assigned thereto for the individual first and second developing devices so that the change-over order for each developing device is determined by said area numbers. That is, in step S208-3, when the first change-over position of the first developing device is specified, area datum No. 1 is set. Similarly, when the second, third, . . . n change-over positions are specified, area data No. 2, No. 3, . . . No. n are set (steps S208-3-2, S208-3-3, . . . S208-3-n). If the first change-over position for the second developing device is specified in step S208-4, then area datum No. 1 is set (step S208-4-1). Similarly, area data No. 2, No. 3, . . . No. n are set in steps S208-4-2, S208-4-3, . . . S208-4-n, and the routine returns to step S209 as shown in FIG. 10.

Single-cycle two-color print data settings express the distance in millimeters from the front edge of the copy paper and are converted to easily handled hexadecimal data through the printer engine interface, which are then sent to the printer as printer control data.

Figure 12A:
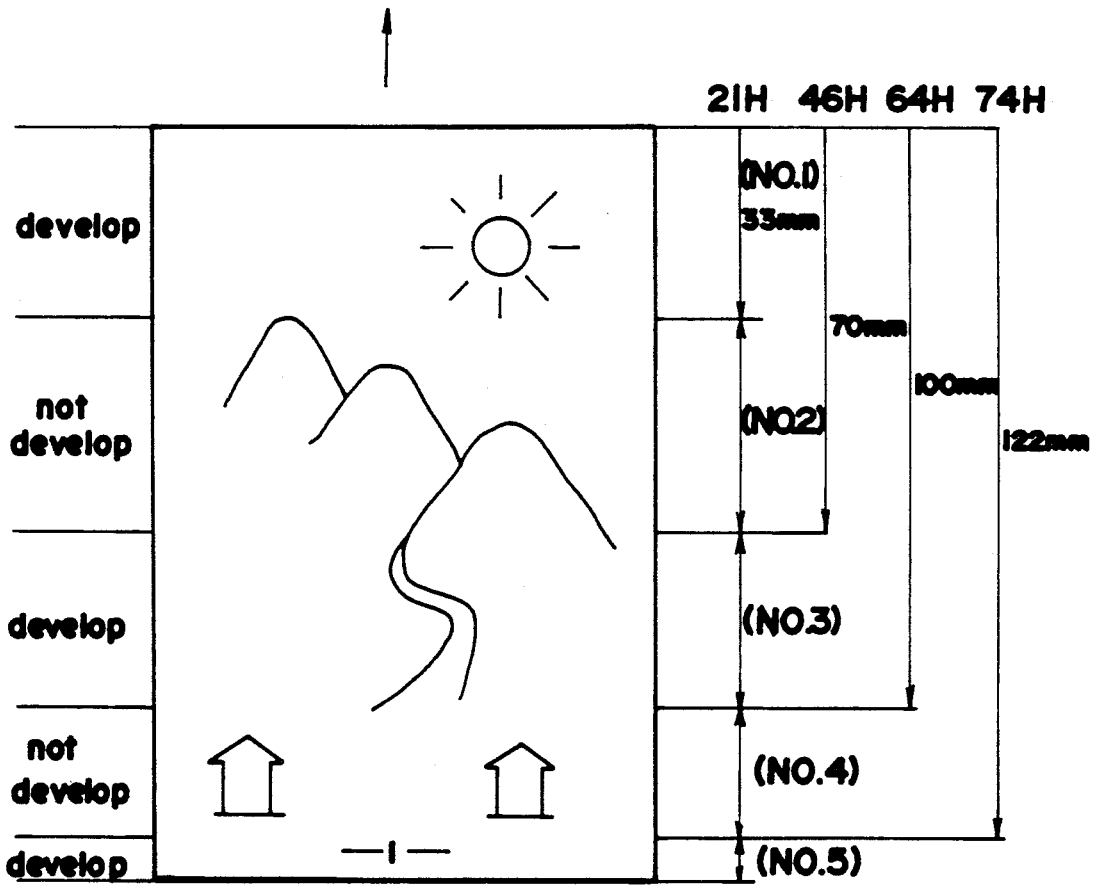
FIG. 12(*a*) shows the area data set mode for the first developing device.
Figure 12B:
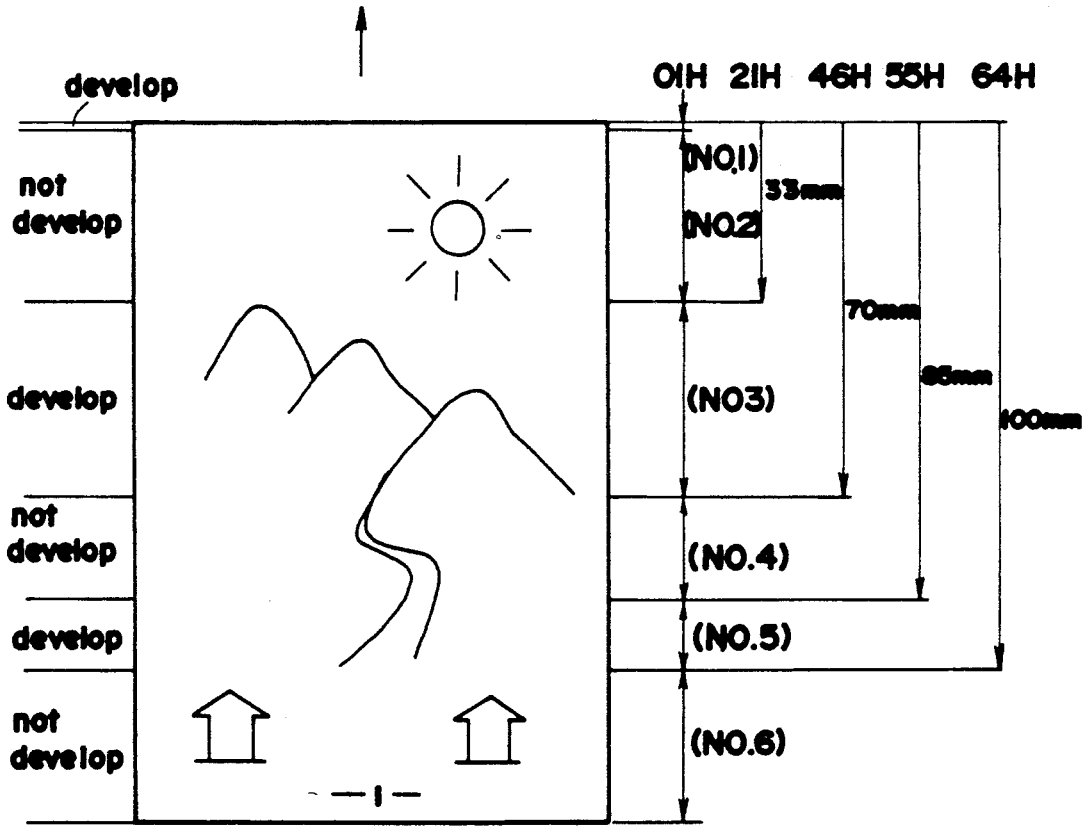
Figure 12C:
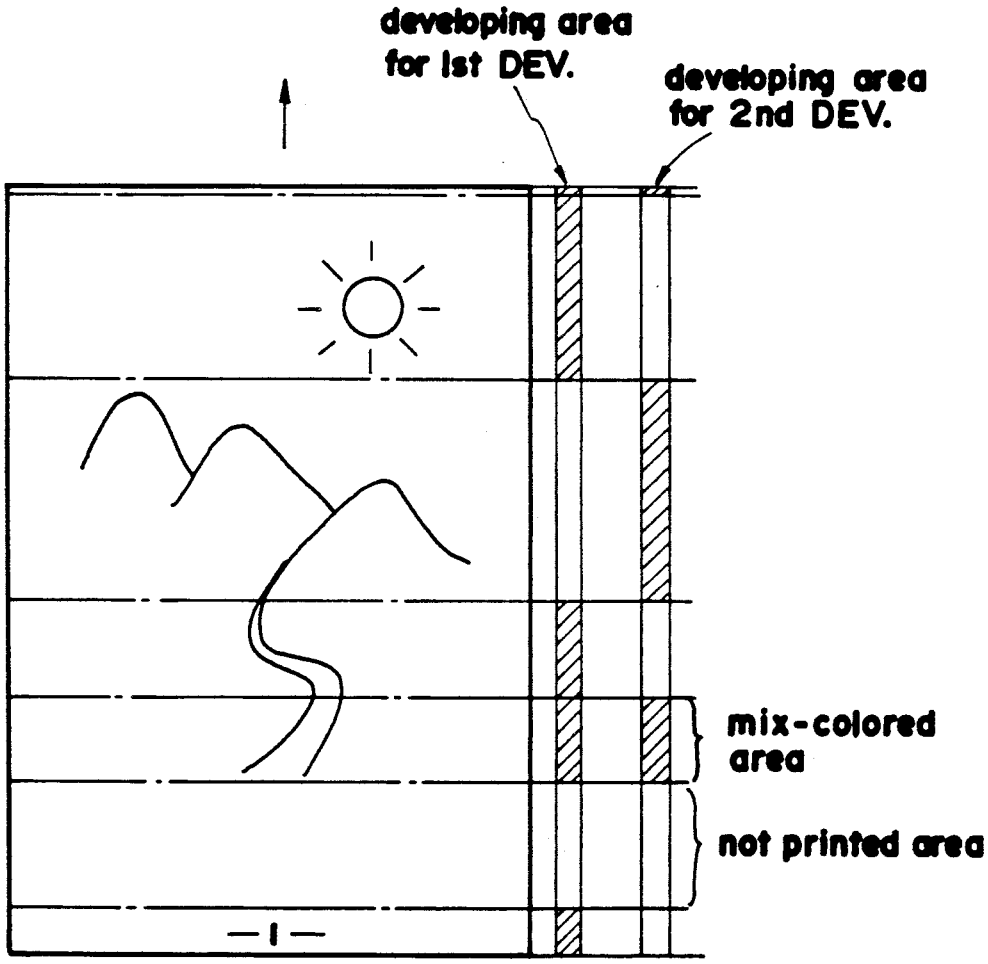

The image obtained from actual area data settings of the first and second developing devices is shown in FIGS. 12(*a*) through 12(*c*). FIG. 12(*a*) shows area data setting modes for the first developing device. Area datum No. 1 is set from the front edge of the copy paper to 33 mm, No. 2 is set from 33 to 70 mm, No. 3 is set from 70 to 100 mm, No. 4 is set from 100 to 122 mm, and No. 5 is set from 122 mm to the end of the copy paper. When development of area datum No. 1 is desired, non-development and development are alternately repeated.

FIG. 12(*b* ) shows area data settings for the second developing device. Area datum No. 1 is set from the front edge of the copy paper to 1 mm, No. 2 is set from 1 to 33 mm, No. 3 is set from 33 to 70 mm, No. 4 from 70 to 85 mm, No. 5 from 85 to 100 mm, and No. 6 from 100 mm to the end of the paper. When development of area datum No. 1 is desired, non-development and development are alrernately repeated.

FIG. 12(*c*) shows the obtained image for area data set as described, which shows regions developed by independent actuation of the first and second developing devices, mixed color regions developed through combined actuation of both developing devices, and non-developed areas generated through non-actuation of both said developing devices.

Figure 13:
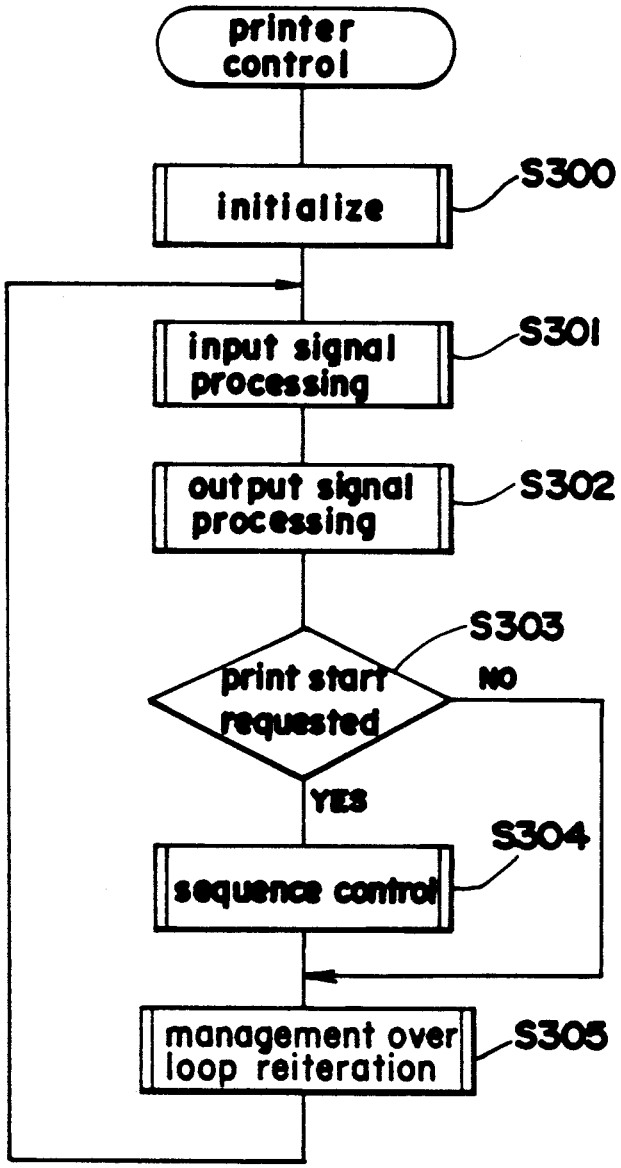
FIG. 13 is a flow chart of the main routine for controlling the printer engine.

FIG. 13 is a flow chart of the main routine of CPU 74 for controlling the printer engine. The printer engine is initialized in step S300. The main loop is entered and the input processing and output processing routines are executed in steps S301 and S302 respectively. In step S303, a check is run to determine if print instructions have been output from the controller, and when print instructions exist the routine continues to step S304 where the sequence control routine is executed. The loop reiteration management routine (loop time management and the like) is executed in step S305, then the sequence returns again to the input processing routine of step S301. When print instructions are not detected in step S303, the aforesaid loop management routine is executed in step S305 and the sequence returns to the input processing routine of step S301.

Figure 14:
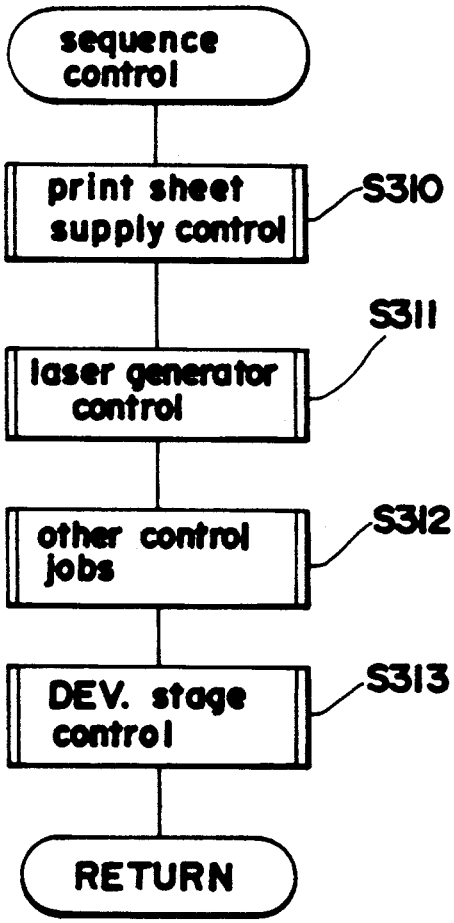
FIG. 14 is a flow chart of the sequence control routine.

FIG. 14 shows the contents of the sequence control routine S304 of FIG. 13. The roller processing routine is executed in step S310 to control copy paper feed/non-feed by the paper rollers. In step S311, the laser (exposure) control routine is executed to control ON/OFF switching of the laser. Other processing routines, such as routines for operation when abnormalities occur, are executed in step S312. In step S313, the developing device control routines are executed to control change-over of the developing devices for single-cycle two-color print modes.

Setting and control of developing device change-over timing for single-cycle two-color print modes are accomplished by the laser (exposure) control routine in step S311, and actual change-over is accomplished by the developing device control routine in step S313.

Figure 15:
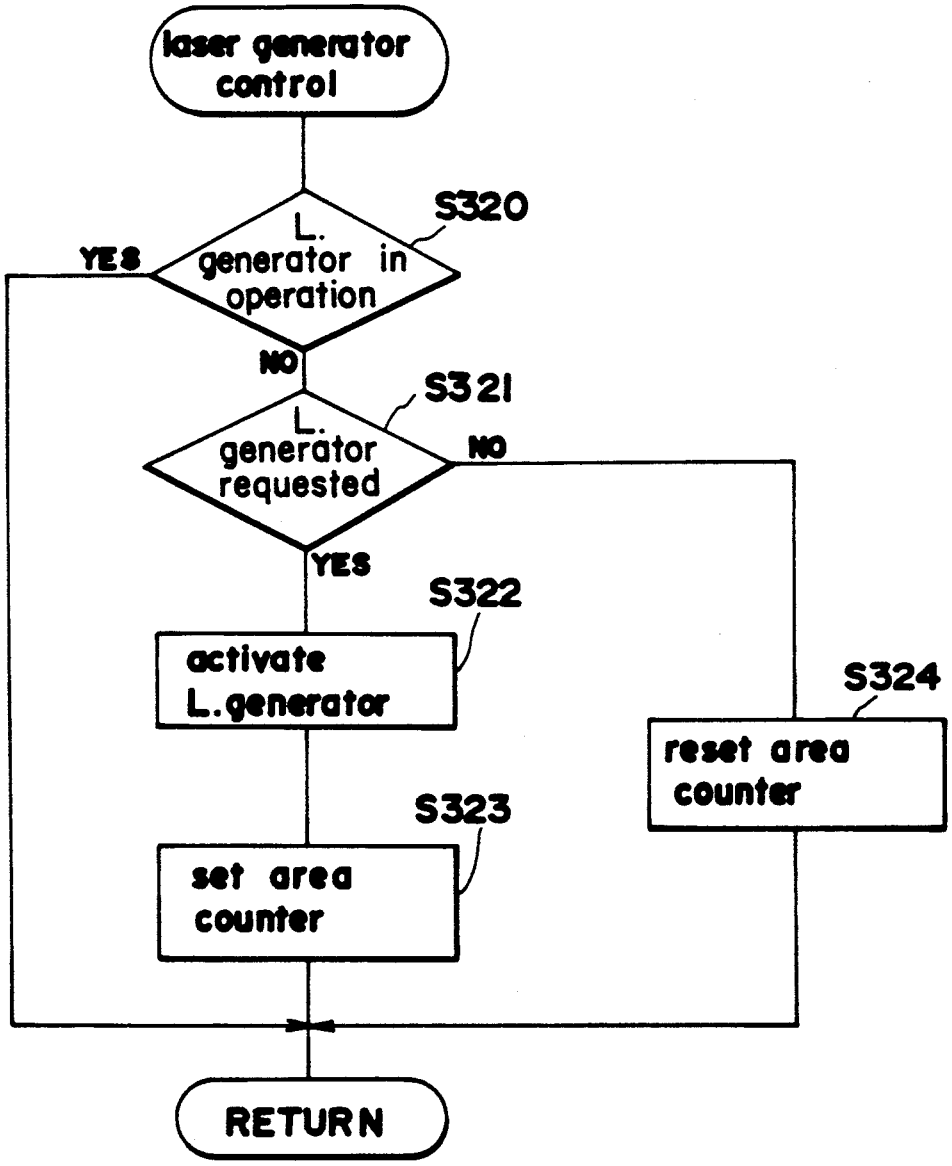
FIG. 15 is a flow chart of the laser (exposure) control routine.

FIG. 15 is a flow chart showing the contents of the laser (exposure) control routine of FIG. 14.

Printer engine 73, which receives the print instructions from controller 72, enters the sequence process as previously described, and a check is run on the laser ON/OFF status in step S320, as shown in FIG. 15. Since the initial laser status is OFF, a check is run in step S321 to determine if a laser ON (exposure) request exists and if so, the laser is switched ON in step S322, and print area counter 76 is set in step S323 to count the pulses detected by photosensitive drum rotation detection encoder 82. The print area counter is reset in the initialization routine previously executed in step S300 (FIG. 13). The main loop then executes one cycle, returns again to the sequence control routine, and the routine returns to the sequence processing loop in FIG. 13 without further processing because a laser ON/OFF check in step S320 indicates that the laser is ON.

Figure 16A:
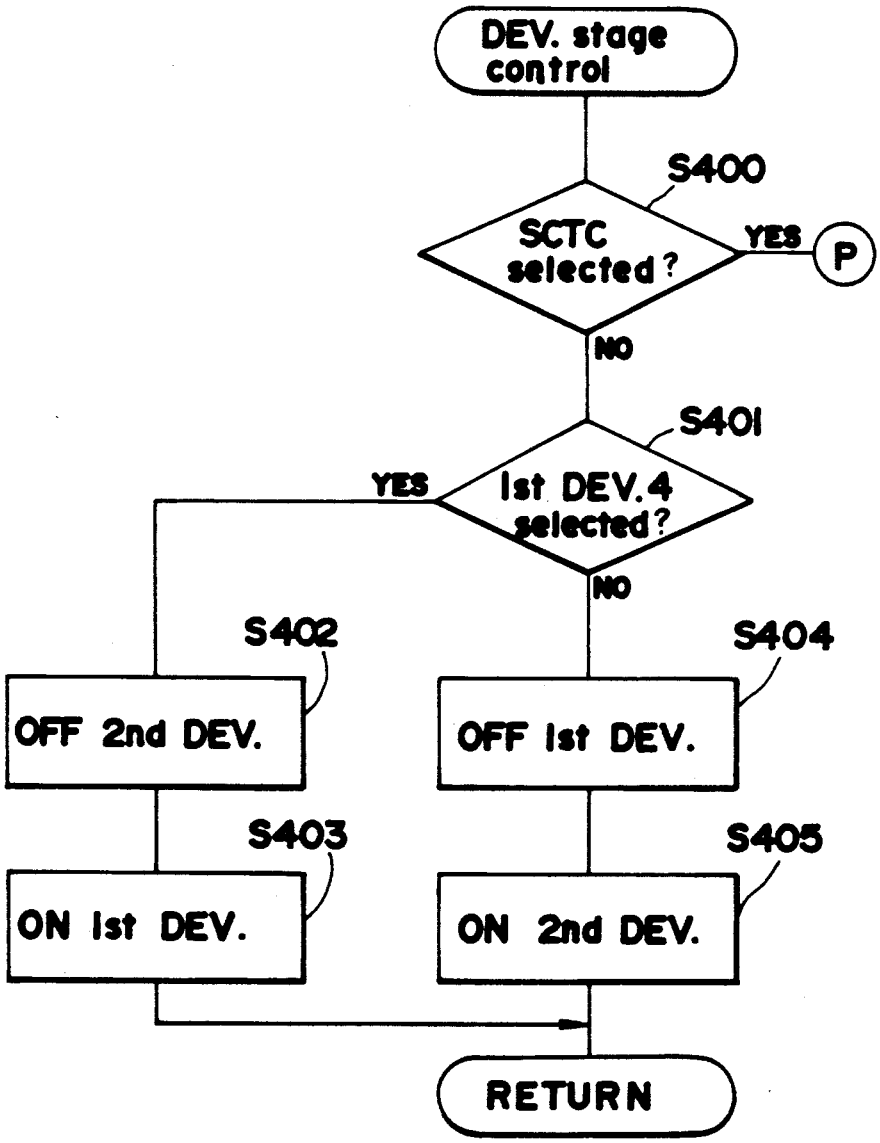
FIGS. 16(*a*) and 16(*b*) are flow charts of the developing stage control routines.
Figure 16B:
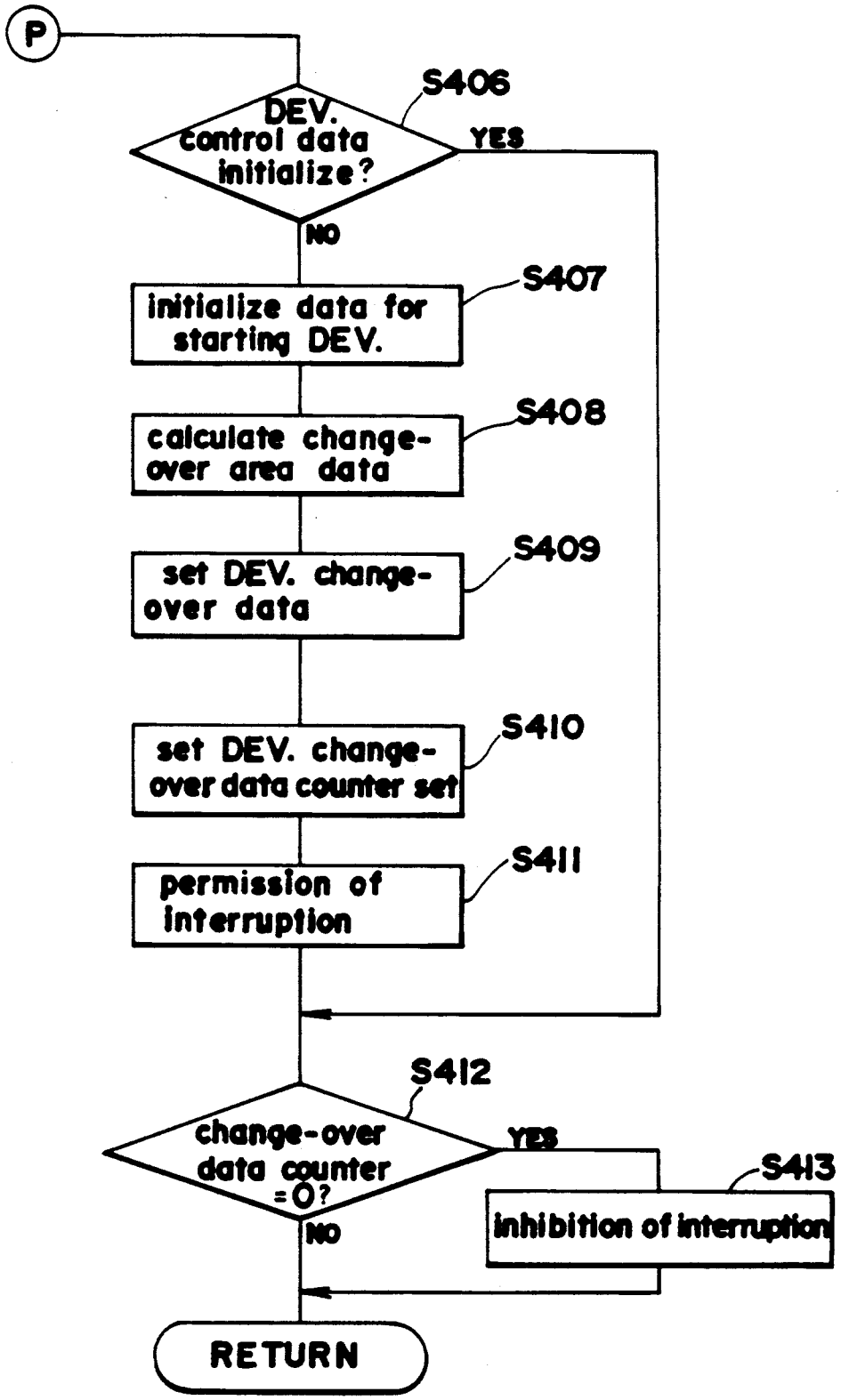

FIG. 16(*a*) and 16(*b*) are flow charts showing details of the developing device control routine S313.

First, a check is run in step S400 to determine whether or not the single-cycle two-color print mode is selected. If the single-cycle two-color print mode is not specified and the normal print mode is indicated, only one of the two developing devices is actuated in steps S401 through S405 to print a single page in only one color. That is, when the first developing device is selected in step S401, the second developing device is switched OFF in step S402 and the first developing device is switched ON in step S403. When the second developing device is selected, the first developing device is switched OFF in step S404 and the second developing device is switched ON in step S405.

When the single-cycle two-color print mode is selected in step S400, the routine continues to step S406 and a determination is made as to whether or not the initial developing device is set for the single-cycle two-color print mode. If said initial device is not set, the initial developing device is then set in step S407.

Continuing to step S408, change-over data for said respective first and second developing devices are calculated using single-cycle two-color print area data output from controller 72 for the first and second developing devices, the rotation angle $\alpha$ from exposure position W to the first developing device, and rotation angle $\beta$ to the second developing device (shown in FIG. 2). The following conversion equations are used:

$$N \cdot d1n/l + N \cdot 2 \cdot \alpha 2\pi \quad \text{(i)}$$

$$Bm = N \cdot d2m/l + N \cdot (\alpha + \beta)/2\pi \quad \text{(ii)}$$

where

An is the nth change-over position of the first developing device (pulse number);

Bm is the mth change-over position of the second developing device (pulse number);

N is the pulse number issued by the encoder per rotation of photosensitive drum 1;

d1n is the nth single-cycle two-color print area datum for the first developing device (in mm), d2m is the mth single-cycle two-color print area datum for the second developing device (in mm), l is the circumferential length of photosensitive drum 1 (in mm).

The aforesaid n and m are the single-cycle two-color print area data for the first and second developing devices respectively; since a plurality of data are assumed, only the area data numbers set for the first and second developing devices are repeatedly calculated through conversion equations (i) and (ii), then sequentially stored in memory.

Next, first datum A1, which is among the first developing device change-over position data An which were calculated by the aforesaid equation (i), is set in first developing device change-over resistor 78, and first datum B1, which is among the second developing device change-over position data Bn which were calculated by the aforesaid equation (ii), is set in second developing device change-over resistor 80 (S409). The numbers of the developing device change-over data for the first and second developing devices calculated in step S408 are stored in the change-over data counter (S410), and the routine continues to step S411 where interruption by the developing device interrupt routine shown in FIGS. 17(*a*) and 17(*b*) is permitted. In step S412, a determination is made as to whether or not the developing device change-over counter registers 0 (zero). If 0 is registered, the developing device interrupt previously described is overridden in step S413 to mask the developing device interruption. If 0 is not registered in the counter, the routine returns to the sequence processing loop without masking the developing device interruption, and the developing device initialization settings are completed. The developing change-over data counter is set for each developing device and decrements with the completion of each single routine in the first and second developing devices interrupt routine described hereinafter and shown in FIGS. 17(*a*) and 17(*b*). Thereafter, a single cycle of the printer control routine is executed and the program continues again to the developing device processing routine, where (step S406) the routines jump to step S412 because the initialization settings are completed.

Subsequently, first and second developing device change-over position data set respectively in first developing device change-over resistor 78 and second developing device change-over resistor 80 (S409) and the counter signal for print area counter 76 are compared by first and second developing device comparators 77 and 79 shown in FIG. 8. When the respective data coincide, comparator 77 generates a first developing device interrupt to CPU 74, and similarly, comparator 79 generates a second developing device interrupt to CPU 74. The CPU 74 then executes the first and second developing device interrupt routines shown in the flow charts in FIG. 17(*a*) and 17(*b*).

A description of the first developing device interrupt routine follows hereinafter with reference to FIG. 17(*a*).

Figure 17A:
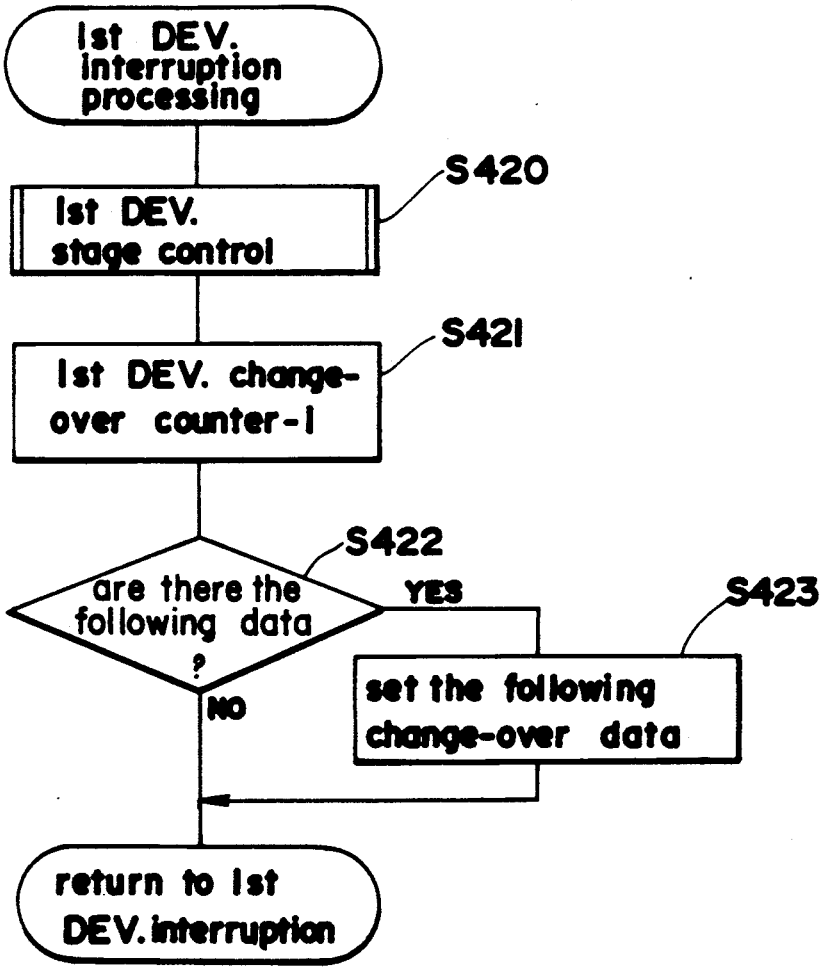
FIG. 17(*a*) is a flow chart of the first developing device interrupt processing routine.
Figure 17B:
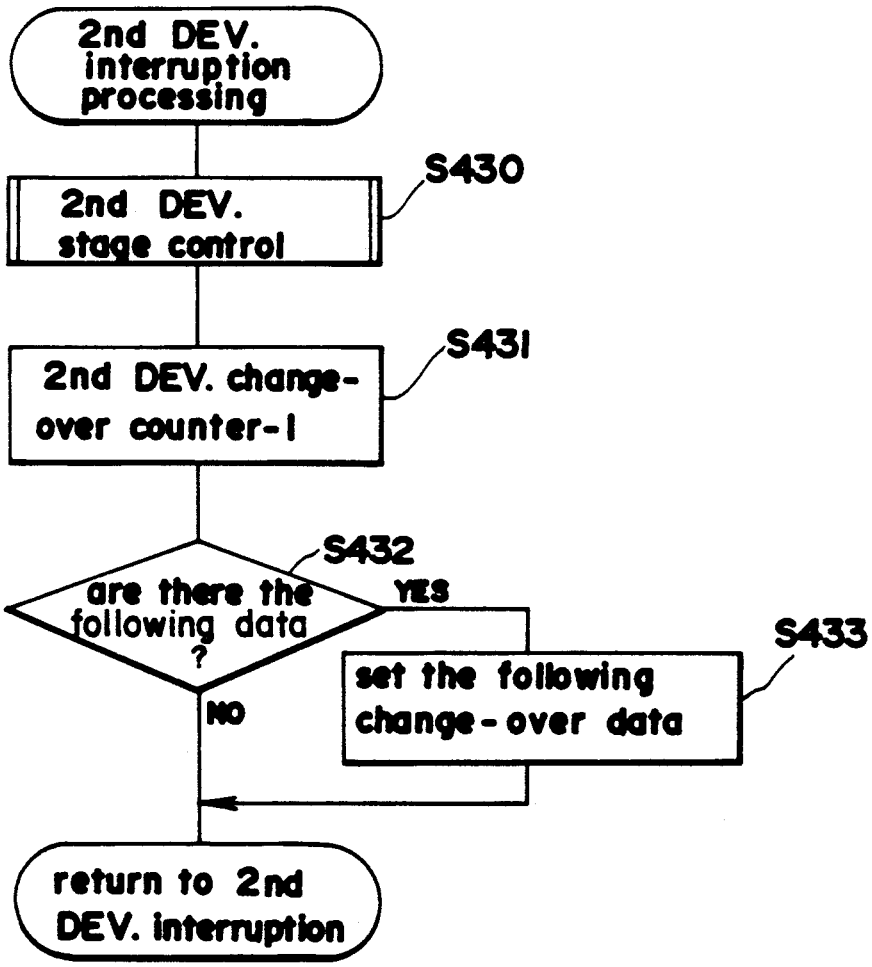
Figure 18A:
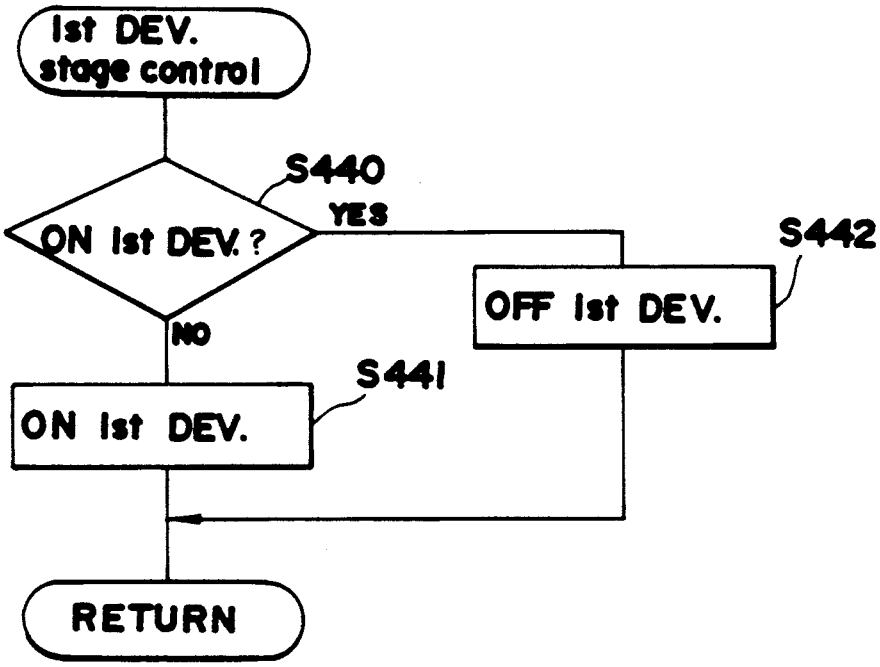
FIG. 18(*a*) is a flow chart of the first developing device control routine.
Figure 18B:
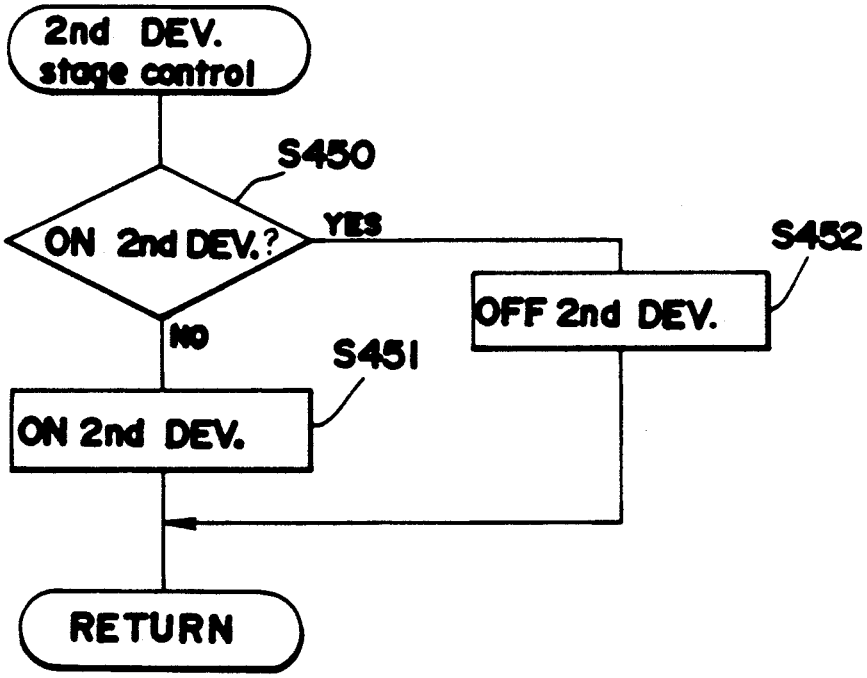

In FIG. 17(*a*), a first developing device routine (FIG. 18(*a*)) may be called in step S420. In the first developing device control routine a determination is made as to whether or not the first developing device is switched ON (S440), and if so it is switched OFF (S442), while if said device is initially switched OFF, it is then switched ON (S441) and the routine returns to step S421 of the first developing device interrupt loop. In step S421, the first developing device change-over position data counter, which was previously set in step S410 of the flow chart of the developing device processing routine shown in FIG. 16(*b*), is decremented. Then in step S422 a determination is made as to whether or not said counter registers 0, i.e., it is determined whether or not subsequent first developing device change-over position data exist. If said counter registers 0, said subsequent change-over position data are set in first developing device change-over position resistor 78 in step S423. If said counter does not register 0, the first developing device interrupt process is terminated, and the sequence returns to normal program routine.

FIG. 17(*b*) shows the second developing device interrupt routine. The contents of said routine is identical to that of the first developing device interrupt process. In step S430, the second developing device interrupt routine (FIG. 18(*b*)) is called and in step S431 the second developing device change-over data counter is decremented. The details of the routine are described herein only briefly since they differ only in that the change-over position data are set in the second developing device change-over position resistor 80 in step S433.

The first and second developing device interrupt processes repeat and complete only the single-cycle two-color print area data number set for both the first and second developing devices, then said first and second device interrupts are masked and the routine returns to the initialized state.

In addition, although in the aforesaid conversion equations (i) and (ii) the change-over area data from the host are based on distance data from the front edge of the copy paper, the values of elements d1n and d2m in said equations (i) and (ii) may be used even when said change-over area data are line numbers or raster numbers from the front edge of the copy paper, and the same developing device change-over process results.

For Line Numbers:

$$d1n = dl \times n1n$$

$$d2m = dl \times n2lm$$

where dl is the width (mm) per line n1ln is the nth change-over line number for the first developing device n2lm is the mth change-over line number for the second developing device For Raster Numbers:

$$d1n = dr \times n1rn$$

$$d2m = dr \times n2rm$$

where dr is the width of one raster n1rn is the nth change-over raster number for the first developing device n2rm is the mth change-over raster number for the second developing device In the latter case, the raster number is counted by raster sensor 81, shown in FIG. 8.

In the present embodiment, the encoder pulse counter which counts encoder pulses from the rotation of the photosensitive drum, the resistors for the developing unit change-over position selection, and the comparators for detecting developing unit change-over positions and generating interrupts are all outside the printer housing. Also, although the present embodiment has been described in terms of interruption processing, internal CPU interrupt processing is also possible by using an internal event counter within said CPU.

Further, all processes which detect the coincidence of change-over areas for a plurality of developing units can be accomplished through software.

In addition, in the present embodiment change-over control of the first and second developing units occurs independently, and change-over control of three or more developing units may also be accomplished independently.

As previously described by way of examples and descriptions of operation, the present invention provides a printer connected to a host means for forming images which comprises first and second developing devices. Each device respectively contains either a first or a second color of developer, and each is selectively driven independently of one another to develop an electrostatic latent image formed on the surface of a photosensitive member. Also, control means are included to control the development of the electrostatic latent image by the first and second developing devices. The control means includes a first mode to develop a first designated part of the latent image by driving the first developing device in a first color, a second mode to develop a second designated part of the latent image by driving the second developing device in a second color, a third mode to develop a third designated part of the latent image by driving both the first and the second developing devices in a third color, and a fourth mode to leave a fourth designated part undeveloped to form a blank position by preventing the first and the second developing devices from being driven. The control means selectively drives the developing devices using at least two of said four modes. Therefore, a printer provided by the present invention can produce various patterns of printing by editing said four modes. For example, printing in a combination of said first mode and third mode, printing in a combination of said second mode and third mode, and printing in a combination of said third mode and fourth mode. Needless to say, the combination of three or all modes may be effected for further editing.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A printer apparatus connected to a host means for forming images which comprises:

a photosensitive member;

an image forming means for forming an electrostatic latent image on the surface of said photosensitive member;

a plurality of developing devices, respectively containing different colors of developer, each of which is driven independently of one another and is selectively driven to develop the electrostatic latent image formed on the surface of the photosensitive member;

an image transfer means for transferring the developed image to a record medium; and control means for controlling driving of said plurality of developing devices in a plurality of different modes during the development of the electrostatic latent image, in which only one of said developing device is driven to develop a first part of the electrostatic latent image in a first mode, at least two developing devices are driven to develop a second part of the electrostatic latent image in a second mode, and all of the developing devices are maintained deenergized to prevent the development of a third part of the electrostatic latent image in a third mode, said control means using at least two of said three modes.

2. A printer apparatus connected to a host means for forming images which comprises:

a photosensitive member;

an image forming means for forming an electrostatic latent image on the surface of said photosensitive member;

first and second developing devices, respectively containing different colors of developer, each of which is driven independently of one another and is selectively driven to develop the electrostatic latent image formed on the surface of the photosensitive member;

an image transfer means for transferring the developed image to a record medium, and control means for controlling driving of said first and second developing devices in three different modes during the development of the electrostatic latent image, in which one of the first and second developing devices is driven to develop a first part of the electrostatic latent image in a first mode, both of the first and second developing devices are driven to develop a second part of the electrostatic latent image in a second mode, and both of the first and second developing devices are maintained deenergized to prevent the development of a third part of the electrostatic latent image in a third mode, said control means using at least two of said three modes.

3. A printer apparatus connected to a host means for forming images which comprises:

a photosensitive member;

an image forming means for forming an electrostatic latent image on the surface of said photosensitive member;

first and second developing devices, respectively containing different colors of developer, each of which is driven independently of one another and is selectively driven to develop the electrostatic latent image formed on the surface of the photosensitive member;

an image transfer means for transferring the developed image to a record medium;

a first designating means for designating a first developing area of the electrostatic latent image which the first developing device is driven to develop;

a second designating means for designating a second developing area of the electrostatic latent image which the second developing device is driven to develop;

a third designating means for designating a third developing area of the electrostatic latent image which both the first and the second developing devices are driven to develop;

a fourth designating means for designating a fourth area to remain undeveloped by maintaining the first and the second developing devices deenergized;

control means for controlling driving of said first and second developing devices in four different modes during the development of the electrostatic latent image, in which the first developing device is driven to develop the first developing area in a first mode, the second developing device is driven to develop the second developing area in a second mode, both the first and the second developing devices are driven to develop the third developing areas in a third mode, and both the first and the second developing devices are maintained deenergized to leave a fourth area undeveloped in a fourth mode, said control means using at least two of said four modes.

4. A printer apparatus connected to a host means for forming images which comprises:

a photosensitive member;

an image forming means for forming an electrostatic latent image on the surface of said photosensitive member;

first and second developing devices, respectively containing a first and a second color of developer, each of which is driven independently of one another and is selectively driven to develop the electrostatic latent image formed on the surface of the photosensitive member;

an image transfer means for transferring the developed image to a record medium; and control means for controlling the development of the electrostatic latent image by said first and second developing devices, including a first mode to develop a first designated part of the latent image in a first color by driving the first developing device, a second mode to develop a second designated part of the latent image in a second color by driving the second developing device, a third mode to develop a third designated part of the latent image in a third color by driving both the first and the second developing devices, and a fourth mode to leave a fourth designating part undeveloped to form a blank portion by preventing the first and the second developing devices from being driven, said control means using at least two of said four modes.

5. A printer for forming an image on a recording medium according to control data received from a host control unit, which include image data, developing device selection data and developing area designating data, said printer comprising:

a photosensitive member;

image forming means for forming an electrostatic latent image on a surface of the photosensitive member according to the image data received from the host control unit;

a first developing device for developing one portion of the electrostatic latent image with a toner of a first color;

a second developing unit for developing another portion of the electrostatic latent image with a toner of a second color different from the first color;

transfer means for transferring the developed image to the recording medium;

switching means for turning on and off the first and the second developing units;

setting means for setting a first switching position to switch the drive of the first developing device and a second switching position to switch the drive of the second developing device according to the control data received from the host control unit, the first and second switching position are set independently from each other; and control means for controlling the switching means to control the drive of the first developing device at the first switching position and to control the drive of the second developing device at the second switching position while development of a page of the electrostatic latent image is being developed.

* * * * *